United States Patent [19]

Julian

[11] Patent Number: 5,040,692

[45] Date of Patent: Aug. 20, 1991

[54] TAMPER INDICATING CLOSURE

[75] Inventor: Randall K. Julian, Evansville, Ind.

[73] Assignee: Sunbeam Plastics Corporation, Evansville, Ind.

[21] Appl. No.: 628,395

[22] Filed: Dec. 17, 1990

[51] Int. Cl.[5] ..... B65D 41/34

[52] U.S. Cl. ..... 215/252; 215/258

[58] Field of Search ..... 215/252, 258

[56] References Cited

U.S. PATENT DOCUMENTS

| | | | |
|---|---|---|---|
| 3,504,818 | 4/1970 | Crisci et al. | 215/252 |
| 3,902,621 | 9/1975 | Hidding | 215/252 |
| 4,062,466 | 12/1977 | Conti | 215/252 |
| 4,448,318 | 5/1984 | Lowe | 215/252 |
| 4,530,436 | 7/1985 | Wiedmer | 215/246 |
| 4,534,479 | 8/1985 | Conti | 215/252 |
| 4,534,480 | 8/1985 | Santostasi et al. | 215/252 |
| 4,550,845 | 11/1985 | Guala | 215/252 |
| 4,592,476 | 6/1986 | Yasada | 215/252 |
| 4,666,053 | 5/1987 | Corcoran et al. | 215/252 |
| 4,915,244 | 4/1990 | Celaschi et al. | 215/252 |

*Primary Examiner*—Stephen Marcus
*Assistant Examiner*—Vanessa M. Roberts
*Attorney, Agent, or Firm*—Gifford, Groh, Sprinkle, Patmore and Anderson

[57] ABSTRACT

A tamper indicating closure for application to a container neck. The closure includes a cap having a top and an internally threaded skirt. A tamper indicating band depends from the bottom of the cap skirt by circumferentially spaced frangible connections. The band has ratchet teeth which engage ratchet teeth on the container neck one at a time during threading-on and unthreading of the cap from the container neck.

13 Claims, 2 Drawing Sheets

TAMPER INDICATING CLOSURE

BACKGROUND OF THE INVENTION

1. Field of the Invention

This invention relates to tamper indicating closures for application to container necks. The tamper indicating feature indicates that the closure has been previously removed or an attempt has been made to remove it from the container. More particularly, this invention relates to a tamper indicating closure in which a tamper indicating band depends from the bottom of the cap skirt by spaced frangible webs. The band has a stop which coacts with a stop on the container neck so that as the closure cap is being unthreaded from the container neck the tamper indicating band is restrained against axial or rotational movement causing fracture of the frangible webs and separation of the band from the cap.

2. Description of the Related Art

At the present time, one of the most commonly used stop means for restraining the movement of the tamper indicating band relative to the container neck and the cap has been the provision of an inwardly directed bead on the tamper indicating band which coacts with an outwardly directed flange on the container neck. In the process of threading the cap onto the container neck the bead on the tamper indicating band snaps over the flange on the container neck. In the unthreading process, the bead is restrained against axial motion by the container flange so that the frangible webs between the bottom of the cap skirt and the top of the tamper indicating band are fractured primarily in tension. There are many shortcomings with this type of tamper indicating band restraint. Among these are skewing of the band so that not all of the tamper indicating webs are broken during the unthreading process. This type of difficulty can be obviated by changing the stops to cooperating ratchet teeth on the tamper indicating band and container neck. In the unthreading direction, radial stop surfaces on the band ratchet teeth abut radial stop surfaces on the container neck ratchet teeth. The frangible webs are thus caused to fracture primarily in shear since the band does not rotate with the cap. However, much more turning torque must be applied to the cap to fracture the webs than with the more gradual stretching of the webs in the bead/flange combination where continued rotation moves the band and the bottom of the cap skirt axially apart as the band bead frictionally engages the container flange during this rotation. With both the cooperating bead/flange embodiment and the cooperating ratchet teeth embodiment there is a likelihood of fracturing the webs during the threading-on operation. In each case, the band must be stretched outwardly in a radial direction either to snap the band bead over the container flange or simultaneously snap the band ratchet teeth over the container neck ratchet teeth.

SUMMARY OF THE INVENTION

The present invention eliminates the difficulties encountered in the prior art structures such as the incomplete fracture of all of the frangible webs during removal which can occur in a snap over bead/flange design, and the premature failure of the frangible webs which can occur in the bead-flange or cooperating ratchet teeth designs during the capping or threading-on process. This is accomplished by utilizing ratchet teeth in a unique arrangement.

The present invention provides a tamper indicating closure for use on a container having a threaded neck with circumferentially spaced ratchet teeth below the threads. The closure includes a cap having a top and a depending annular skirt with threads for engaging the container neck threads. A resilient tamper indicating band depends from the bottom of the cap skirt by a plurality of circumferentially spaced frangible connections. Usually these take the form of webs of finite length having a degree of flexibility. The tamper indicating band has a number of circumferentially spaced ratchet teeth which are arranged in a staggered relationship relative to the ratchet teeth on the container neck so that as the closure is being threaded onto the container neck, the ratchet teeth on the tamper indicating band will sequentially meet and pass over the ratchet teeth on the container neck. This sequential passing over of the ratchet teeth allows the cap to be applied with considerably less torque than the prior art devices in which the ratchet teeth on the tamper indicating band simultaneously pass over the ratchet teeth on the container neck. With the closure of the invention the band is only momentarily outwardly distorted at one point at a time.

Many other advantages are evident from this sequential arrangement such as the fact that the frangible connections can be made with sufficient strength to assure there will be no fracture when the cap is being threaded-on, but sequential breakage during removal will keep the removal torque to a comfortable level.

Either the ratchet teeth on the band and/or the ratchet teeth on the container neck, and preferably both have ramp surfaces which cooperate with each other in the threading-on direction to facilitate the passage of the ratchet teeth on the band over the ratchet teeth on the container neck. This reduces the torque necessary and the abrupt deformations of the band when the individual teeth on the tamper indicating band pass the individual teeth on the container neck.

Each of the ratchet teeth on the tamper indicating band and the container neck have radially extending stop surfaces which will sequentially engage each other when the closure is being unthreaded. Since the tamper-indicating band will stop rotation at the point of engagement of the stop surfaces of the first band and container neck ratchet tooth during the unthreading process, the band must yield or be deformed to bring the second and subsequent pairs of band and container neck ratchet teeth into contact as continued rotational movement is imparted to the cap. This will cause sequential fracture of the frangible connections.

The material from which the closure is molded and the dimensioning of the tamper indicating band are selected along with the spacing of the ratchet teeth so that upon engagement of the first ratchet tooth on the band with the first ratchet tooth on the container neck, the cap must be turned in the unthreading direction through an angle A and the band be caused to yield or be deformed to move the second, circumferentially adjacent, ratchet tooth on the band through an angle A for engagement with the second circumferentially adjacent ratchet tooth on the container neck. These factors, particularly the selection of the plastic material, can be made so that the band will be plastically or elastically elongated to move the second ratchet tooth on the band into contact with the second ratchet tooth on the container neck. Likewise, these factors can be so chosen that the band will be plastically or elastically flexed to move the second ratchet tooth on the band into contact with the second ratchet tooth on the container neck. Practically any of the common thermo-plastic materials such as polypropylene can be used as long as the material is hard enough to retain the function of the ratchet tooth. Elastic flexure is preferred over plastic or elastic elongation as the mode of enabling the band to yield and move with the cap for greater reproducability or repeatability of overall performance and less dependence on material properties or physical dimensions.

This pattern of circumferential spacing of the ratchet teeth on the band relative to the ratchet teeth on the container neck continues so that upon engagement of the second and subsequent ratchet tooth on the band with the second and subsequent ratchet tooth on the container neck, the cap must be turned in the unthreading direction through an additional angle A and the band flexed and moved to move the third and subsequent, circumferentially adjacent, ratchet tooth on the band through an angle A for engagement with the third and subsequent, circumferentially adjacent, ratchet tooth on the container neck. Thus, the angular displacement of the tamper indicating band between the second and third tooth is increased by the angle A over the angular displacement between the first and second tooth, and the angular displacement of the tamper indicating band between the third and fourth tooth is increased by the angle 2A over the angular displacement between the first and second tooth. This pattern is repeated so that the angular displacement at tooth number n is $(n-1)A$ where n is any tooth between the first tooth in sequence and tooth number N, N being the total number of ratchet teeth on the tamper indicating band.

The frangible connections are circumferentially spaced around the closure as the ratchet teeth are located around the tamper indicating band. The frangible connection or connections in the general proximity of or in the sector of the first ratchet tooth on the band to engage a ratchet tooth on the container neck will fracture with continued rotation of the cap relative to the band which is stationary at this first point of engagement. At that point other frangible connections will still be intact because there has been no relative motion between the cap and band in their vicinity. As the band deforms allowing the second pair of band and container ratchet teeth to engage, the movement of the band at that point is arrested so that continued rotation of the cap creates fracturing stress in the frangible connection in the second sector or in the general vicinity of the second ratchet tooth pair. The process is continued in a stepwise fashion as the third and subsequent ratchet tooth pairs are brought sequentially into engagement by continuing rotation of the cap and deformation of the band so that each frangible connection or group of connections in the general vicinity or sector of each of the pairs of ratchet teeth are broken sequentially. With a larger number of ratchet teeth for a given size closure it is possible that more than one ratchet teeth pair will engage before the initial fracture. For example with a closure having eight ratchet teeth on the tamper indicating band, it is possible that two and even three teeth will engage before frangible web breakage occurs associated with or in the sector of the first ratchet tooth.

In addition to variations in diameter and circumferential spacing of the ratchet teeth between the tamper indicating closure band and the container neck, the arc length of the ratchet teeth on the band must be considered. These variable factors can be selected so that at nominal dimensioning, the band flexure as the cap is being unthreaded from the point of contact of the first ratchet tooth on the band and the container neck to the point of contact between the second ratchet tooth on the band and container neck, will cause the band between the first and second ratchet tooth on the band to be forced into contact with the container neck, and the slack in the band will be pushed counterclockwise beyond the second and subsequent ratchet teeth to accumulate between the last ratchet tooth and the first ratchet tooth on the band and container neck to engage. With variations in manufacturing tolerances, this contact can be such that at least a portion of the band assumes an arcuate configuration in contact with the container neck between the first and second ratchet teeth on the band and between subsequent ratchet teeth as the closure cap is further unthreaded. The central arcuate contact of the band with the container neck can vary from virtually complete contact, through a point at which there is a chordal portion adjacent the first and second ratchet teeth on the band to a point where the band assumes a substantially straight chord configuration between the first and second ratchet teeth.

In the forgoing embodiments of the invention, when all of the frangible connections have been fractured, the tamper indicating band breaks free from the cap skirt to remain on the container neck as the cap is fully unthreaded and removed from the container neck. This gives a clear indication to the prospective customer that prior opening or tampering has taken place.

Another primary advantage afforded by the sequential alignment of the ratchet teeth on the band with the ratchet teeth on the container neck is that when the cap is in its fully tightened condition there can be no more than one crest to crest engagement of a ratchet tooth on the band with a ratchet tooth on the container neck. When all the teeth engage at the same time and there is crest to crest engagement of the ratchet teeth, a permanent set is likely to occur because of the existence of this condition from the time of capping through shipment to the point of sale which will make the ratchet teeth nonfunctioning.

In another embodiment of the invention, there will be one non-frangible connection between the tamper indicating band and the cap skirt. This non-frangible or permanent web will extend between the top of the band and the bottom of the cap skirt and be at a point adjacent to the last band ratchet tooth to engage a container neck ratchet tooth during unthreading. The band will also have an axially or vertically extending frangible area adjacent to this non-frangible web. This can take the configuration of a gap in the band forming adjacent free ends of the band with a circumferential extending frangible web connecting these two ends. When the cap is unthreaded to the point where all of the frangible connections between the cap skirt and band have been fractured and the last ratchet tooth is in contact with the ratchet tooth on the container neck adjacent the permanent web, the frangible area or the circumferentially extending frangible web will be fractured, allowing the band to open up and the cap to be completely unthreaded from the container neck with the band remaining tethered to the cap by the permanent web. This embodiment is preferred in such applications as, for example, where the closure is applied to plastic quart oil container where it is desirable that the band be carried away with the cap to eliminate the possibility of the band sliding off the container neck and into an engine crank case when the container has been inverted to allow oil to flow from the container into the crank case.

BRIEF DESCRIPTION OF THE DRAWING

The preferred embodiments of the invention are illustrated in the drawing in which:

FIG. 3 shows the position of the tamper indicating band relative to the container neck as the closure is being unthreaded in the direction of the arrow, and the stop surface on a first ratchet tooth of the tamper indicating band has made contact with the stop surface of a first ratchet tooth on the container neck. It can be seen that the tamper indicating band will have to be moved with the closure through an angular displacement of an angle A for the next counterclockwise ratchet tooth on the tamper indicating band to come into contact with the next stop surface of the ratchet tooth on the container neck and that subsequent contacts between the ratchet teeth on the tamper indicating band and container neck will be obtained by further rotations through the angle A;

FIG. 4 shows the further rotation of the closure so that the second ratchet tooth on the tamper indicating band has made contact with the second ratchet tooth on the container neck, and the band has been flexed enough so as to fracture the first frangible web shown as the dot on the dash line circle representing the cap skirt connection, having been moved away from the circle connection of the web to the tamper indicating band;

FIG. 5 shows the closure having been further rotated to bring a third ratchet tooth on the tamper indicating band in contact with a third ratchet tooth on the container neck with the band having been flexed sufficiently to fracture the second frangible web, the third and fourth frangible webs remain intact;

FIG. 6 shows the closure having been rotated still further in the counterclockwise unthreading direction so that all of the ratchet teeth on the tamper indicating band have made contact with ratchet teeth on the container neck, but the cap has not been rotated far enough to fracture the last frangible web;

FIG. 7 shows the closure having been rotated far enough to sever the last frangible web between the tamper indicating band and the cap skirt with the band being in the position of its maximum outward flexure;

DETAILED DESCRIPTION OF THE PREFERRED EMBODIMENTS OF THE INVENTION

Figure 1:
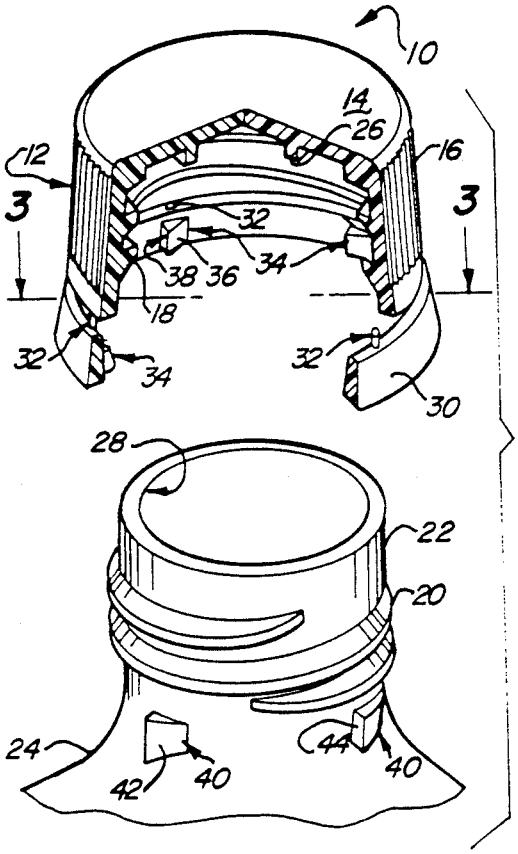
FIG. 1 is an exploded perspective view of the closure of this invention as it will be applied to a container neck with a portion of the closure broken away to show the details of the closure cap and the closure tamper indicating band which is connected to the bottom of the cap skirt by frangible connections or webs. For illustration purposes the frangible webs are shown in substantial alignment with ratchet teeth on the tamper indicating band. It will be apparent from this view how the ramps on the tamper indicating band ratchet teeth slide over the ramps on the container neck ratchet teeth when the closure is turned in a tightening or threading-on direction. Likewise it can be seen that radial stop surfaces on the tamper indicating band ratchet teeth will engage radial stop surfaces on the container neck ratchet teeth in the unthreading direction of the closure from the container neck.

Referring to FIG. 1, the closure 10 of this invention is shown as including a cap 12 having a top 14 and annular skirt 16 depending from the periphery of the top. The skirt has internal threads 18 which engage external threads 20 on the neck 22 of container 24. Cap 12 may have an internal sealing ring or plug 26 depending from top 14 which engages the internal diameter 28 of container neck 22. Other suitable sealing means can be used.

Closure 10 has a tamper indicating band 30 which depends from the bottom of cap skirt 16 by frangible connections or webs 32. In the embodiment of FIGS. 1–7 four such circumferentially equally spaced webs are shown. The number of webs can be varied for different applications, but typically with a one inch or 28 mm closure 2 to 8 webs will be used.

Tamper indicating band 30 contains inwardly directed ratchet teeth 34 each having a sloped ramp surface 36 and a radial stop surface 38. There is one ratchet tooth 34 in substantial alignment with each of the frangible webs 32. This alignment of the frangible web with a ratchet tooth can be desirable from a mold design standpoint, but it is not a functional requirement. These will generally be one or more frangible connections in a sector or circumferential extent of or influence of a given ratchet tooth. Container neck 22 has the same number of ratchet teeth 40 as band ratchet teeth 34 located below external thread 20 each having a corresponding sloped ramp surface 42 and a radial stop surface 44.

As with a conventional tamper indicating closure having a depending tamper indicating band with ratchet teeth for engagement with ratchet teeth on a container neck, when the cap of the closure is being threaded onto the container neck, the ramp surfaces 36 of the band ratchet teeth 34 will engage the ramp surfaces 42 of the container neck ratchet teeth 40 to permit the band ratchet teeth 34 to pass over the container neck ratchet teeth 40. Likewise, in the unthreading direction, the stop surfaces 38 of the band ratchet teeth 34 will engage the stop surfaces 44 of the container neck ratchet teeth 40 to prevent further rotation. It is at this point that the present invention differs from the prior art. In the prior art devices the engagement of the band ratchet teeth 34 with the container neck ratchet teeth 40 is simultaneous in both the threading-on direction and in the unthreading direction. In the threading-on direction this requires the distortion of the tamper indicating band 30 around its entire periphery to push the band ratchet teeth 34 past the container neck ratchet teeth 40. This requires considerable force even with cooperating ramp surfaces 36 and 42 on the band and container neck ratchet teeth respectively. This in turn subjects the frangible connections 32 to premature failure or requires a sturdier construction which then may cause difficulties in breaking of the connections during the unthreading operation. Likewise, in the unthreading direction, the simultaneous engagement of all of the band stop surfaces 38 with the container neck stop surfaces 44 requires a considerable force to be exerted on the closure cap in order to simultaneously fracture all of the frangible connections 32.

The present invention obviates the problems persisting in the prior art use of ratchet teeth as the means for arresting relative movement between the tamper indicating band and the closure cap in order to provide a positive fracture of the frangible connections.

Figure 3:
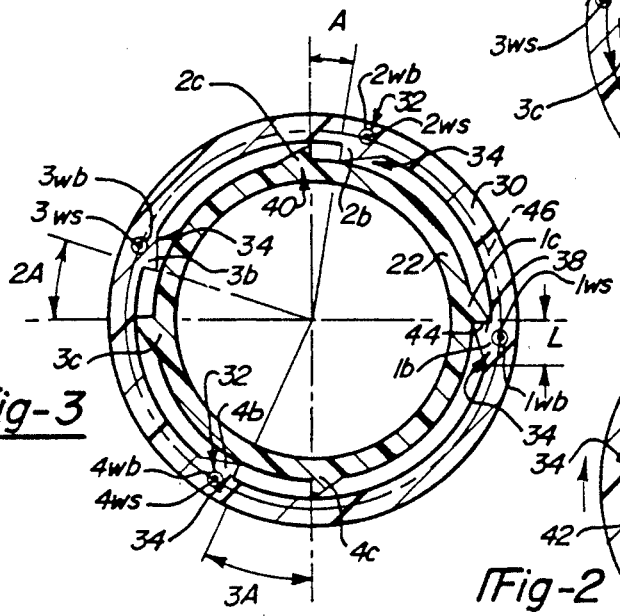

Referring to FIG. 3, successive band ratchet teeth 34 are offset circumferentially from container neck ratchet teeth 40 by increasing amounts indicated by the acute angle A. With a first band ratchet tooth 1*b* in contact with a first container neck ratchet tooth 1*c*, the second band ratchet tooth 2*b* is circumferentially offset from the second container neck ratchet tooth 2*c* by the acute angle A. The third band ratchet tooth 3*b* is circumferentially offset from the third container neck ratchet tooth 3*c* by the acute angle 2A. The fourth band ratchet tooth 4B is circumferentially offset from the fourth container neck ratchet tooth 4C by the acute angle 3A. For a closure with N ratchet teeth, the angular displacement of successive band ratchet teeth from the container neck ratchet teeth will progress from an angular displacement of A° through (N−1)A°.

Figure 4:
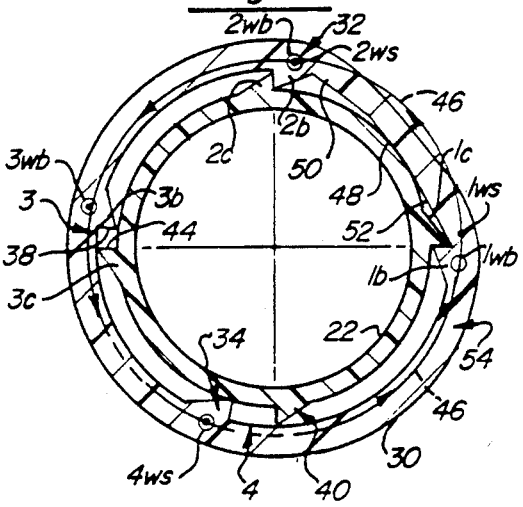
FIG. 3–7 are cross-sectional views similar to FIG. 2, taken along line 3—3 of FIG. 1 but showing the closure in a progressive sequence as it is being unthreaded from the container neck with the tamper indicating band being progressively deformed or flexed forwardly in the direction of unthreading and outwardly radially. The dash line circle and dots schematically show the position of the attachment points of the frangible webs to the cap skirt relative to the small circles which show the points of attachment of the frangible webs to the tamper indicating band; the further showing in these figures is as follows.
Figure 5:
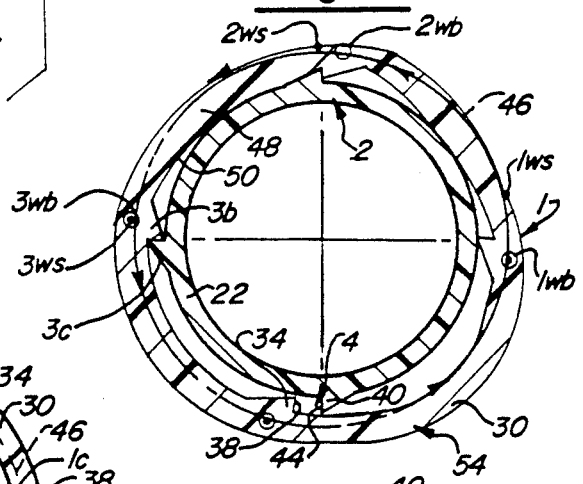
Figure 6:
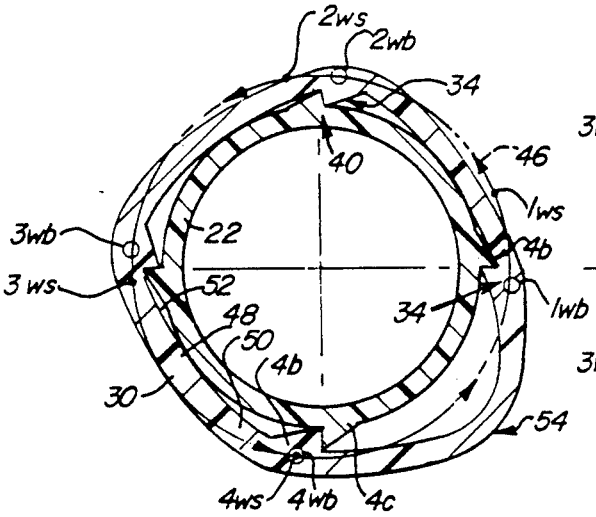
Figure 7:
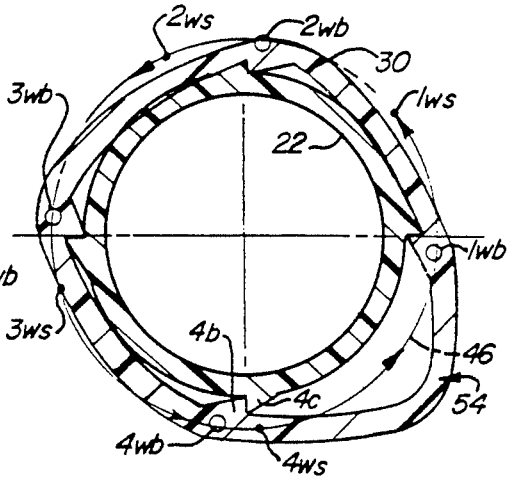

It can be observed in the four ratchet teeth embodiments of FIGS. 1–7, as best seen in FIG. 3, that the container neck ratchet teeth 1*c*, 2*c*, 3*c* and 4*c* are equally spaced apart at 90°. With the angle A being, for example, 5°; this would provide a angular spacing between band ratchet teeth 1*b* and 2*b*, between 2*b* and 3*b* and between 3*b* and 4*b* of 85° each. This would result in an angular spacing between band ratchet teeth 4*b* and 1*b* of 105°. As will be explained in reference to the unthreading sequence shown from FIGS. 3–7, this results in an increasing amount of band bulge between container ratchet teeth 4*c* and 1*c* shown at 54. The bulge is a maximum when all four band ratchet teeth 1*b*, 2*b*, 3*b* and 4*b* are in contact with the four container neck ratchet teeth 1*c*, 2*c*, 3*c* and 4*c*, pushing out 15° of band slack at 54 between container ratchet teeth 4*c* and 1*c* as shown in FIGS. 6 and 7.

Figure 2:
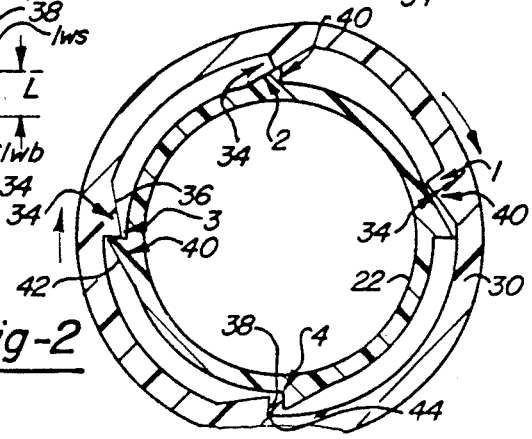
FIG. 2 is a cross-sectional view taken along line 3—3 in FIG. 1 of the closure as it is being applied to the container neck showing the sequential engagement of the ratchet teeth on the tamper indicating band with the ratchet teeth on the container neck.

Referring to FIG. 2, when the closure is rotated in the clockwise direction as shown by the arrows, the tamper indicating band ratchet teeth 34 will sequentially contact and pass over the container neck ratchet teeth 40 as their respective ramp surfaces 36 and 42 engage. The pair of band and container ratchet teeth 2 are shown approaching the peak of passing over each other with a small outward deflection of the band 30 at this point; the amount of outward deflection has been exaggerated in FIG. 2 for clarity. Pairs 3, 4 and 1 of band and container ratchet teeth are completely out of engagement with each other.

Referring to FIG. 3, the frangible webs 32 are shown in alignment with their respective band ratchet teeth 34. The circles 1*wb*, 2*wb*, 3*wb* and 4*wb* represent the attachment points of the webs 32 to the band 30 in alignment with band ratchet teeth 1*b*, 2*b*, 3*b* and 4*b* respectively. The dashed circle 46 is used to indicate the location of the bottom of the cap skirt 16 so that the dots 1*ws*, 2*ws*, 3*ws* and 4*ws* on this circle 46 represent the attachment points of the webs 32 to the cap skirt 16. In FIG. 3, the cap has been unthreaded only to the point of contact of the first band ratchet tooth 1*b* with the first container neck ratchet tooth 1*c* so that no shearing force has been applied to any of the frangible webs 32, and the concentric alignment of web attachment points to the cap skirt, dots 1*ws*, 2*ws*, 3*ws* and 4*ws* with the web attachment point to the band, circles 1*wb*, 2*wb*, 3*wb* and 4*wb*, indicates no fracture has occurred.

In FIG. 4, continued rotation of the cap through an angle A has brought the second band ratchet tooth 2*b* into contact with the second container ratchet tooth 2*c*, and as the rotation is continued, the third band ratchet tooth 3*b* is drawn closer to the third container ratchet tooth 3*c*. During this process, the first frangible web has been fractured so that its point of attachment to the bottom of the cap skirt at 1*ws* has moved away from its point of attachment to the tamper indicating band at 1*wb*. The second and subsequent frangible webs 32 have not been fractured so that their respective points of attachment to the band and cap skirt are shown in alignment.

As seen in FIG. 4, the band flexure necessary to bring the second band ratchet tooth 2*b* into contact with the second container band ratchet tooth 2*c* has flexed the band between the first and second pairs of ratchet teeth 1 and 2 to bring the band 30 into contact with the container neck 22 in the center arcuate contact area 48. The band has a substantially chordal portion 50 adjacent to the band ratchet tooth 2*b* and another chordal portion 52 adjacent to the first ratchet tooth 1*b*. The amount of arcuate contact area 48 and chordal portions 50 and 52 will depend on where the particular closure 10 and container 24 are within the manufacturing tolerances permitted from the largest cap and smallest container neck to the smallest cap and largest container neck. Likewise, the value of the acute angle A will depend upon the outside diameter of the container neck 22, the inside diameter of the tamper indicating band 30 and the actuate base circle length L of the band ratchet teeth 34 as seen in FIG. 3. Also the depth of the ratchet tooth indicated by the radial extent of its stop surface 38 will be a factor. For example, with a 28 mm or approximately a one inch closure diameter and a ratchet tooth depth running between 3/32"–⅛" the angle A may be 6°–8° whereas with the depth of a ratchet tooth closer to 1/20" the angle A will be 3°-4° to assure adequate contact and frangible web fracture. With a nominal value of A=6° proper functioning must take place with the loosest combination of the largest cap and smallest container neck which would create an angle A for example of 5½° and likewise properly function with the tightest combination of the largest container neck and the smallest closure diameter the angle A may be for example 6½°. With a closure using only two ratchet teeth of reasonable depth, the slack or angle A may fall between 20° and 30°. Similarily, a one inch cap having eight ratchet teeth will use an angle between 1° and 2°. These figures are intended to allow the artisan to design the closure with the number of ratchet teeth suited to a particular application.

As the tamper indicating band is flexed to bring the next pair of ratchet teeth into engagement, the slack in the band is pushed beyond the last engaging band and container neck ratchet tooth, causing the band to bulge outwardly before the first set of engaging ratchet teeth as shown at 54.

FIG. 5 shows the additional rotation of the cap so as to bring the third band ratchet tooth 3*b* into contact with the third container neck ratchet tooth 3*c*, and as the rotation is continued, the fourth band ratchet 4*b* is drawn closer to the fourth container ratchet tooth 4*c*. In the process the second frangible web 32 has been fractured, separating the point of attachment of the web with the cap skirt at 2*ws* from the point of attachment of the frangible web to the band at 2*wb*. The third and fourth frangible webs have not been fractured so that their respective point of attachment to the band and cap skirt are shown in alignment.

Further rotation as shown in FIG. 6 brings the last or fourth band ratchet tooth 4*b* into contact with the fourth container neck ratchet tooth 4*c*, and continuing rotation causes fracture of the frangible web 32 at 3 separating the connection of the web to the band at 3*wb* from the connection of the web to the cap skirt at 3*ws*. As the slack in the band continues to be taken up, the bulge at 54 before the first set of ratchet teeth increases.

Finally, additional rotation breaks the frangible connection 32 at the fourth pair of ratchet teeth 4 separating the point of connection of the frangible web with the cap skirt 4*ws* with the point of connection 4*wb* of the web to the band. At this point, the band breaks free of the cap, and the cap is removed by finishing its unthreading.

Figure 8:
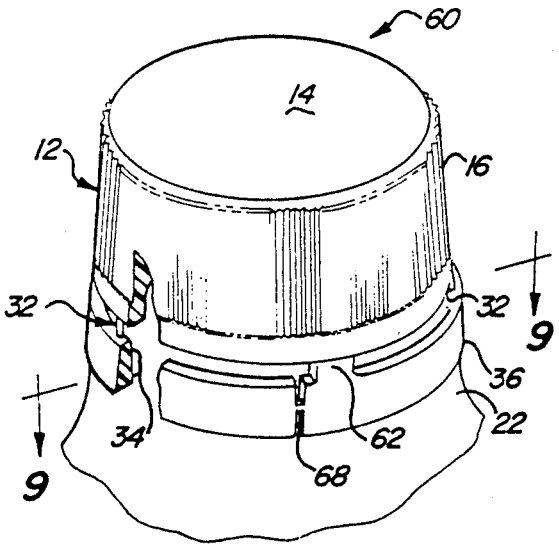
FIG. 8 is a perspective view of another embodiment of the closure of this invention as it has been threaded onto a container neck with a portion of the closure broken away to show the details thereof including a permanent, axially extending, web, and an axially or vertically extending frangible area on the band in the form of a radial separation in the tamper indicating band, and a frangible circumferentially extending web between the band ends created by the radial separation.
Figure 9:
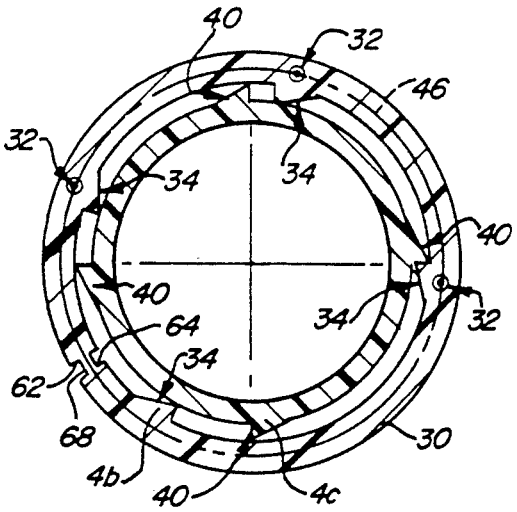
FIG. 9 is a cross-sectional view taken along line 9—9 of FIG. 8 showing the closure to have been partially unthreaded in a counterclockwise direction, bringing a first ratchet tooth on the tamper indicating band into contact with a first ratchet tooth on the container neck.
Figure 10:
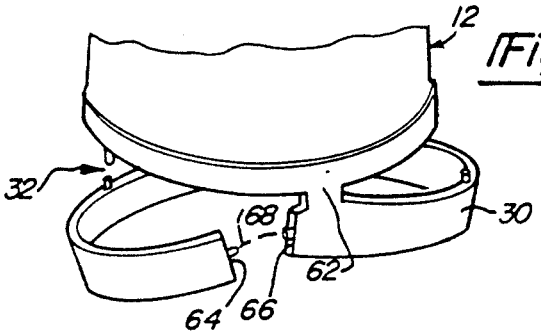
FIG. 10 is a partial perspective view showing the closure to have been unthreaded from the container neck with all of the frangible webs having been broken but with the tamper indicating band remaining tethered to the bottom of the cap skirt by the permanent, axially extending web.

In the embodiment of FIGS. 8-10, the closure 60 operates in the same manner as the closure 10 of FIGS. 1-7 with the sequential engagement of ratchet teeth 34 on the tamper indicating band 30 with ratchet teeth 40 on the container neck 22. The axial extending frangible webs 32 are fractured sequentially as the cap 12 is being unthreaded. This closure is designed to maintain the tamper indicating band 30 tethered to the cap skirt 16 when the cap 12 is removed from the container neck 22.

With closure 60, the axially extending frangible web associated with the last tamper indicating band ratchet tooth to engage the container neck ratchet tooth in the former embodiments is eliminated, and a permanent web 62 is substituted. The tamper indicating band 30 has an axially or vertically extending frangible area which is illustrated by making the band circumferentially discontinuous, having an axial line of separation upstream from the last band ratchet tooth, forming free adjacent opposing ends 64 and 66 which are joined by a circumferentially extending frangible web 68. When the last band ratchet tooth 4*b* engages the last container neck ratchet tooth 4*c*, continuing rotation shears the circumferentially extending frangible web 68 permitting the band 30 to open up and allowing the cap 12 to be completely unthreaded with band 30 attached. This closure provides evidence of initial opening or tampering without leaving the tamper indicating band on the container neck.

The embodiments of the invention in which an exclusive property or privilege is claimed are defined as follows:

1. A tamper indicating closure for use on a container having a threaded neck with circumferentially spaced ratchet teeth below the threads, said closure comprising:

a cap having a top and a depending annular skirt having threads for engaging the container neck threads;

a resilient tamper indicating band depending from the bottom of said cap skirt by a plurality of circumferentially spaced frangible connections;

a plurality of circumferentially spaced ratchet teeth on said band for engagement with the ratchet teeth on the container neck;

wherein the ratchet teeth on said band are circumferentially spaced on the band relative to the ratchet teeth on the container neck so that as the closure is being threaded onto the container neck contact between mating pairs of the ratchet teeth on said band and the ratchet teeth on the container neck will occur in sequence between individual pairs of said teeth.

2. The tamper indicating closure according to claim 1 wherein the ratchet teeth on said container neck and the ratchet teeth on said band have ramp surfaces which cooperate with each other in the threading-on direction to facilitate the passage of the ratchet teeth on the band over the ratchet teeth on the container neck.

3. The tamper indicating closure according to claim 1 wherein the ratchet teeth on said band and container neck have cooperating radially extending stop surfaces and the ratchet teeth on said band are circumferentially spaced on the band relative to the ratchet teeth on the container neck so that when the closure is unthreaded from the container neck the stop surfaces on the ratchet teeth on the band will sequentially engage the stop surfaces on the ratchet teeth on the container neck such that sequential fracture of said frangible connections will occur.

4. The tamper indicating closure according to claim 3 wherein the ratchet teeth on the band are circumferentially spaced relative to the ratchet teeth on the container neck, the closure is made with a deformable material and the band is dimensioned so that upon engagement of the first ratchet tooth on the band with the first ratchet tooth on the container neck, the cap must be unthreaded through an angle A and the band deformed to move the second, circumferentially adjacent, ratchet tooth on the band through an angle A for engagement with the second circumferentially adjacent, ratchet tooth on the container neck.

5. The tamper indicating closure according to claim 4 wherein said material is a selected plastic and the band is dimensioned so that the band will be stretched to move the second ratchet tooth on the band into contact with the second ratchet tooth on the container neck.

6. The tamper indicating closure according to claim 4 wherein said material is a selected plastic and the band is dimensioned so that the band will be flexed to move the second ratchet tooth on the band into contact with the second ratchet tooth on the container neck.

7. The tamper indicating closure according to claim 6 wherein the ratchet teeth on the band are circumferentially spaced relative to the ratchet teeth on the container neck so that upon engagement of the second ratchet tooth on the band with the second ratchet tooth on the container neck, the cap must be unthreaded through an angle A and the band flexed to move the third and subsequent, circumferentially adjacent, ratchet tooth on the band through an angle A for engagement with the third and subsequent, circumferentially adjacent, ratchet tooth on the container neck.

8. The tamper indicating closure according to claim 7 wherein said frangible connections are located in sectors associated with each ratchet tooth on said band, at least one frangible connection in each sector, and the frangible connection in the sector of said first ratchet tooth does not fracture until after the first ratchet tooth on said band is engaged with the first ratchet tooth on said container neck, and the frangible connection in the sector associated with said second ratchet tooth does not fracture until after the second ratchet tooth on said band is engaged with the second ratchet tooth on the container neck.

9. The tamper indicating closure according to claim 7 including:

a permanent web between said band and the bottom of said cap skirt adjacent the last ratchet tooth on said band to engage a ratchet tooth on said container neck;

said band having an axially extending frangible area adjacent said last ratchet tooth; and wherein when said cap has been unthreaded to the point where all of said frangible connections have been fractured and said last ratchet tooth on said band is in contact with a ratchet tooth on said container neck, said axially extending frangible area will fracture allowing the band to open up and the cap to be completely unthreaded from the container neck with the band being tethered to the cap by said permanent web.

10. The tamper indicating closure according to claim 9 wherein said axially extending frangible area includes an axial separation in said band adjacent said last ratchet tooth forming adjacent free ends of said band and a circumferentially extending frangible web connecting said ends whereby fracture of said axially extending frangible area occurs by fracture of said circumferentially extending frangible web.

11. A tamper indicating closure for use on a container having a threaded neck with circumferentially spaced ratchet teeth below the threads, said closure comprising:

a cap having a top and a depending annular skirt having threads for engaging the container neck threads;

a resilient tamper indicating band depending from the bottom of said cap skirt by a plurality of circumferentially spaced frangible webs;

a plurality of N circumferentially spaced ratchet teeth on said band for engagement with the ratchet teeth on the container neck;

wherein successive ratchet teeth on said band are circumferentially spaced on the band relative to the ratchet teeth on the container neck by a serially increasing angular displacement represented by $(n-1)A$ where A is an acute angle and n is a tooth in sequence from the first tooth to tooth number N so that as the closure is being threaded onto the container neck mating pairs of ratchet teeth on said band and ratchet teeth on the container neck will engage and pass over each other in sequence between individual pairs of said teeth, and as the closure is unthreaded from the container neck engagement between mating pairs of ratchet teeth on the container band and ratchet teeth on the container neck will occur in sequence between individual pairs of said teeth, and said frangible webs will be fractured in sequence in relation to the mating pairs of teeth.

12. The tamper indicating closure according to claim 11 wherein the acute angle A is between 2° and 30° and N is from 2 to 8.

13. A tamper indicating closure for use on a container having a threaded neck with circumferentially spaced ratchet teeth below the threads, said closure comprising:

a cap having a top and a depending annular skirt having threads for engaging the container neck threads;

a resilient tamper indicating band depending from the bottom of said cap skirt by a plurality of circumferentially spaced axially extending frangible webs;

a plurality of circumferentially spaced ratchet teeth on said band for engagement with the ratchet teeth on the container neck;

a permanent web between said band and the bottom of said cap skirt adjacent the last ratchet tooth on said band to engage a ratchet tooth on said container neck;

said band having an axially extending frangible area adjacent said last ratchet tooth; and wherein successive ratchet teeth on said band are circumferentially spaced on the band relative to the ratchet teeth on the container neck by a serially increasing angular displacement of A where A is an acute angle so that as the closure is being threaded onto the container neck mating pairs of ratchet teeth on said band ratchet teeth on the container neck will pass over each other in sequence between individual pairs of said teeth, and as the closure is unthreaded from the container neck engagement between mating pairs of ratchet teeth on the container band and ratchet teeth on the container neck will occur in sequence between individual pairs of said teeth; and said axially extending frangible webs and said axially extending frangible area will be fractured allowing the band to open up and the cap to be completely unthreaded from the container neck with the band being tethered to the cap by said permanent web.

* * * * *